US005950338A

United States Patent [19]

Lin

[11] Patent Number: 5,950,338

[45] Date of Patent: Sep. 14, 1999

[54] CYLINDER-TYPE PERPETUAL CALENDAR ASSEMBLY

[76] Inventor: Jong-Meei Lin, No. 502-1, Fuhsing Rd. Fuhsing Li, Tsaotun Chen, Nantou Hsien, Taiwan

[21] Appl. No.: 09/031,311

[22] Filed: Feb. 25, 1998

[51] Int. Cl.[6] ..... G09D 3/06; G09D 3/08

[52] U.S. Cl. ..... 40/114; 40/111

[58] Field of Search ..... 40/111, 114, 113, 40/115, 503, 504, 660; 283/2

[56] References Cited

U.S. PATENT DOCUMENTS

| | | | |
|---|---|---|---|
| 2,400,268 | 5/1946 | Skene | 40/111 X |
| 2,998,666 | 9/1961 | Stern | 40/114 |
| 4,376,346 | 3/1983 | Nelson | 40/114 |
| 5,581,920 | 12/1996 | Hydary | 40/114 |

FOREIGN PATENT DOCUMENTS

| | | | |
|---|---|---|---|
| 443743 | 2/1968 | Switzerland | 40/114 |
| 380301 | 9/1932 | United Kingdom | 40/111 |

*Primary Examiner*—Terry Lee Melius
*Assistant Examiner*—James M Hewitt

[57] ABSTRACT

A perpetual calendar assembly includes a transparent outer cylinder having a first end portion, a mediate portion and a second end portion. A first opaque ring-shaped piece is mounted on the first end portion of the outer cylinder and longitudinally defines a first viewing slot. A second opaque ring-shaped piece is mounted on the second end portion of the outer cylinder and longitudinally defines a second viewing slot. A first inner cylinder is rotatably mounted in the outer cylinder and includes a first portion received in the first end portion of the outer cylinder and a second portion received in the mediate portion of the outer cylinder. A second inner cylinder is rotatably mounted in the outer cylinder and includes a first portion received in the second end portion of the outer cylinder and a second portion received in the mediate portion of the outer cylinder.

11 Claims, 4 Drawing Sheets

CYLINDER-TYPE PERPETUAL CALENDAR ASSEMBLY

FIELD OF THE INVENTION

The present invention relates to a perpetual calendar assembly, and more particularly to a cylinder-type perpetual calendar assembly.

BACKGROUND OF THE INVENTION

A conventional perpetual calendar including a complex structure is not easily understood by an ordinary user such that the user has to spend considerable time in calculation so as to obtain the actual date he/she hopes to find, thereby causing an inconvenience in use.

The present invention has arisen to mitigate and/or obviate the disadvantage of the conventional perpetual calendar.

SUMMARY OF THE INVENTION

In accordance with one aspect of the present invention, there is provided a perpetual calendar assembly comprising a transparent outer cylinder including a first end portion, a mediate portion and a second end portion. A first opaque ring-shaped piece is mounted on the first end portion of the outer cylinder and longitudinally defines a first viewing slot. A second opaque ring-shaped piece is mounted on the second end portion of the outer cylinder and longitudinally defines a second viewing slot.

A first inner cylinder is rotatably mounted in the outer cylinder and includes a first portion received in the first end portion of the outer cylinder and a second portion received in the mediate portion of the outer cylinder. A second inner cylinder is rotatably mounted in the outer cylinder and includes a first portion received in the second end portion of the outer cylinder and a second portion received in the mediate portion of the outer cylinder.

Further features of the present invention will become apparent from a careful reading of the detailed description with appropriate reference to the accompanying drawings.

DETAILED DESCRIPTION OF THE PREFERRED EMBODIMENTS

Figures 1, 7:
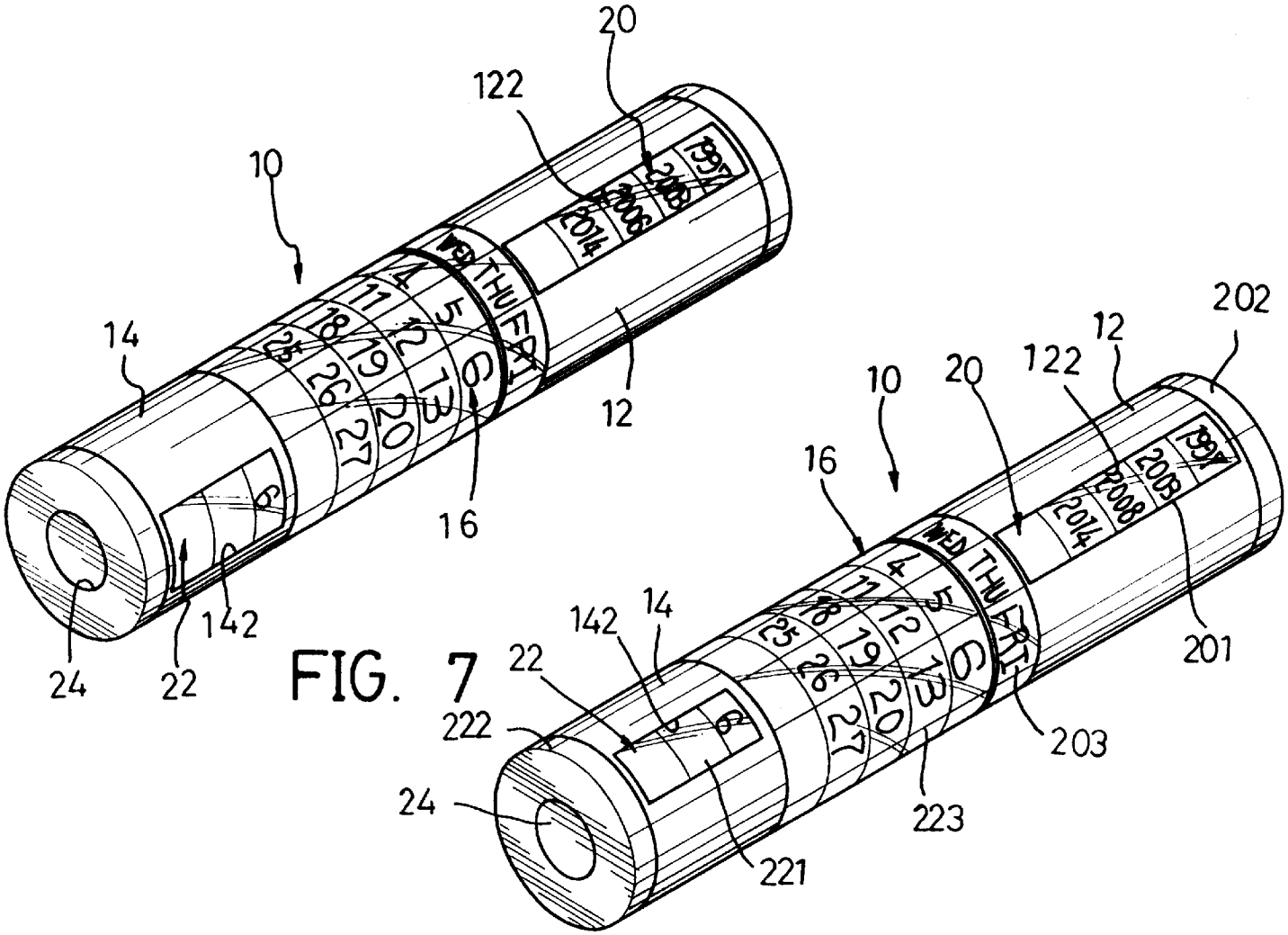
FIG. 1 is a perspective view of a perpetual calendar assembly according to a first embodiment of the present invention.
FIG. 7 is a perspective view of a perpetual calendar assembly according to a fourth embodiment of the present invention.

Referring to the drawings, and initially to FIGS. 1–4, a cylinder-type perpetual calendar assembly in accordance with a first embodiment of the present invention comprises a transparent outer cylinder 10 including a first end portion 11, a mediate portion 16 and a second end portion 13.

A first opaque ring-shaped piece 12 is mounted or printed on the first end portion 11 of the outer cylinder 10 and longitudinally defines a first viewing slot 122. A second opaque ring-shaped piece 14 is mounted or printed on the second end portion 13 of the outer cylinder 10 and longitudinally defines a second viewing slot 142. The first viewing slot 122 is preferably co-axially arranged with the second viewing slot 142.

A first inner cylinder 20 is rotatably mounted in the outer cylinder 10 and includes a first portion 200 received in the first end portion 11 of the outer cylinder 10 and a second portion 204 received in the mediate portion 16 of the outer cylinder 10.

A second inner cylinder 22 is rotatably mounted in the outer cylinder 10 and includes a first portion 220 received in the second end portion 13 of the outer cylinder 10 and a second portion 224 received in the mediate portion 16 of the outer cylinder 10.

The first inner cylinder 20 is formed with an annular flange 202 abutting on the first end portion 12 of the outer cylinder 10, and the second inner cylinder 22 is formed with an annular flange 222 abutting on the second end portion 14 of the outer cylinder 10. A retaining axle 24 extends through the first inner cylinder 20 and the second inner cylinder 22, thereby coupling them together.

Figure 3:
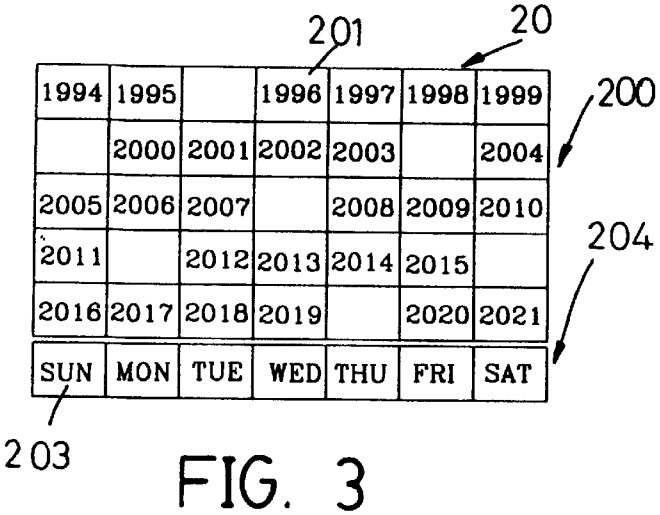
FIG. 3 is a top plan view showing an expansion of a first inner cylinder of the perpetual calendar assembly shown in FIG. 1.

Especially referring to FIG. 3, the first portion 200 of the first inner cylinder 20 is formed with seven first longitudinal lines intersecting with a plurality of first transverse lines, thereby defining a plurality of first spaces 201 in each of which a first number is printed, and the second portion 204 of the first inner cylinder 20 is formed with seven second longitudinal lines intersecting with two second transverse lines, thereby defining seven second spaces 203 in each of which a second number is printed.

The first number printed in each of the first spaces 201 represents a particular year which extends from left to right in a successive manner and begins with the year 1994 to terminate at the year 2021. It is to be noted that a blank is disposed between a leap year and a former year. For example, a blank is disposed between the year 1995 and the leap year 1996.

The second number printed in each of the seven second spaces 203 represents a corresponding one day of a week, that is, the labels SUN, MON, TUE, WED, THU, FRI and SAT are serially arranged from left to right the second spaces 203 Sunday, Monday, Tuesday, Wednesday, Thursday, Friday and Saturday.

Figure 4:
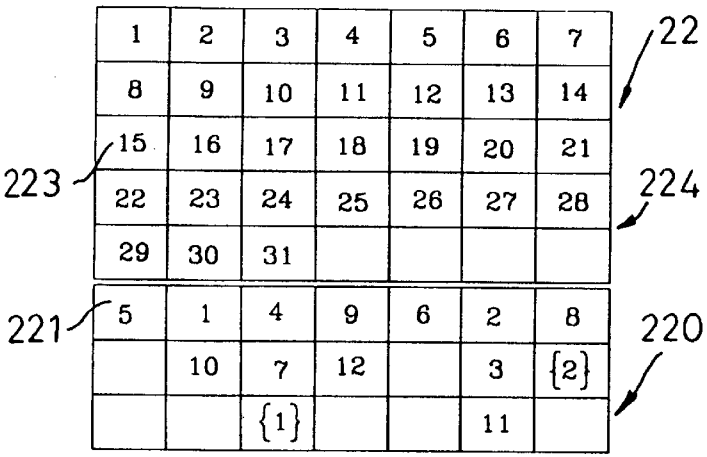
FIG. 4 is a top plan view showing an expansion of a second inner cylinder of the perpetual calendar assembly shown in FIG. 1.

Especially referring to FIG. 4, the first portion 220 of the second inner cylinder 22 is formed with seven third longitudinal lines intersecting with a plurality of third transverse lines, thereby defining a plurality of third spaces 221 in each of which a third number is printed, and the second portion 224 of the second inner cylinder 22 is formed with seven fourth longitudinal lines intersecting with a plurality of fourth transverse lines, thereby defining a plurality of fourth spaces 223 in each of which a fourth number is printed.

The third number printed in each of the third spaces 221 represents a particular month. In practice, as shown in FIG.

4, the numbers 5, 1, 4, 9, 6, 2 and 8 are serially arranged in a first row of the third spaces 221 from left to right so as to represent the months May, January, April, September, June, February and August respectively, the numbers 10, 7, 12 and 3 are arranged in a second row of the third spaces 221 to represent the months October, July, December and March respectively, and the number 11 is arranged in a third row of the spaces 221 to represent the month November.

It is to be noted that the labels {2} and {1} are arranged in the second and the third row of the third spaces 221 respectively to represent the first and the second month (i.e. January and February) of the leap years such as the year 1996.

The fourth number printed in each of the fourth spaces 223 represents a corresponding one of thirty-one days which extend from right to left in a successive manner and begins with the date 1 to terminate at the date 31 as shown in FIG. 4.

Figure 2:
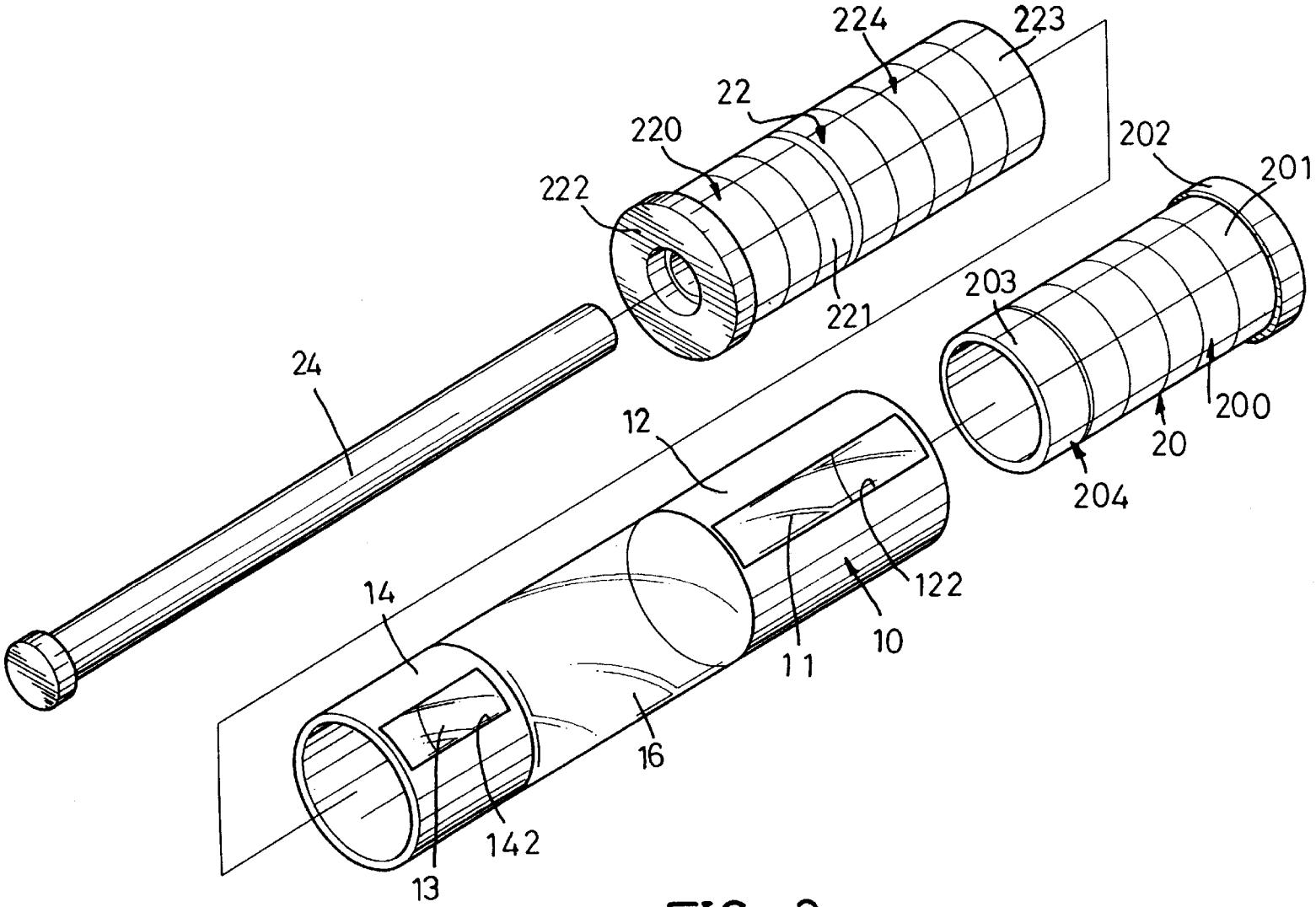
FIG. 2 is an exploded view of the perpetual calendar assembly shown in FIG. 1.

In operation, referring now to FIG. 1 with reference to FIGS. 2 4, when a user intends to find the dates in June, 1997, the first inner cylinder 20 can be rotated in the outer cylinder 10 so as to align a column thereof comprising the number 1997 with the first viewing slot 122. The second inner cylinder 22 can then be rotated in the outer cylinder 10 so as to align a column thereof comprising the number 6 with the second viewing slot 142 such that all of the dates in June, 1997 can be clearly displayed on the perpetual calendar assembly as best shown in FIG. 1.

By such an arrangement, the dates in every year can be displayed on the perpetual calendar assembly by means of rotating the first inner cylinder 20 and the second inner cylinder 22 relative to the outer cylinder 10.

Figure 5:
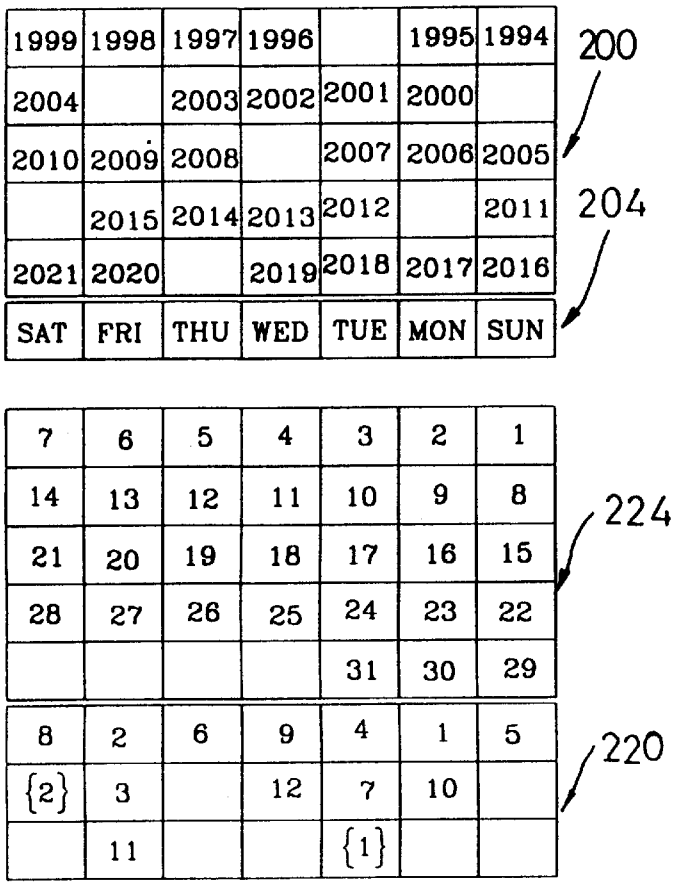
FIG. 5 is a top plan view showing an expansion of a first inner cylinder and a second inner cylinder of a perpetual calendar assembly in accordance with a second embodiment of the present invention.

Referring now to FIG. 5 with reference to FIGS. 3 and 4, in accordance with a second embodiment of the present invention, all of the first numbers, second numbers, third numbers and fourth numbers can be serially arranged from right to left.

Figure 6:
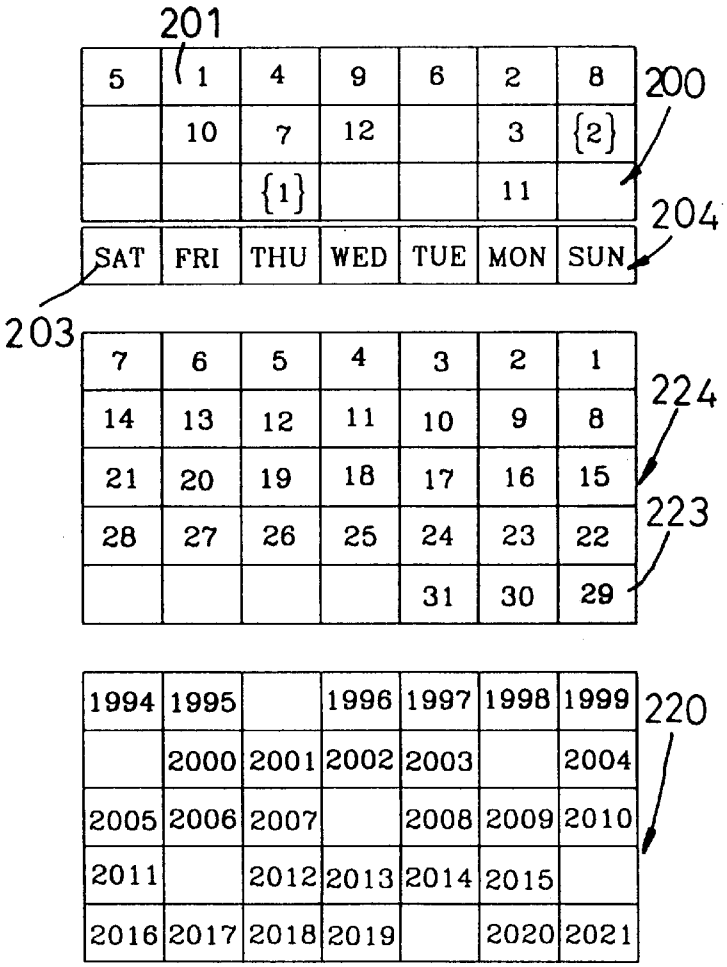
FIG. 6 is a top plan view showing an expansion of a first inner cylinder and a second inner cylinder of a perpetual calendar assembly according to a third embodiment of the present invention.

Referring now to FIG. 6 with reference to FIGS. 3 and 4, in accordance with a third embodiment of the present invention, the first numbers in the first spaces 201 can be interchanged with the third numbers in the third spaces 221 In addition, the second numbers (or labels) in the second spaces 203 and the fourth numbers in the fourth spaces 223 are serially arranged from right to left.

Figure 8:
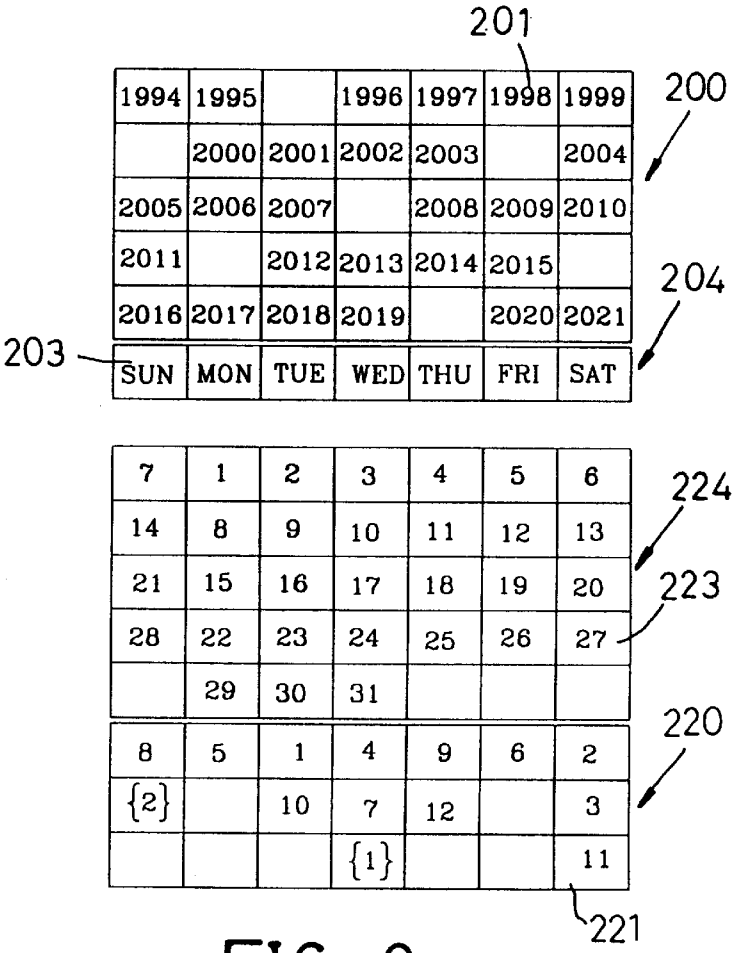
FIG. 8 is a top plan view showing an expansion of a first inner cylinder and a second inner cylinder of the perpetual calendar assembly shown if FIG. 7.

Referring now to FIGS. 7 and 8 with reference to FIGS. 1–4, in accordance with a fourth embodiment of the present invention, the first view slot 122 and the second viewing slot 142 are not co-axially arranged with each other. In such a situation, the first numbers, the second numbers and the fourth numbers remain unchanged, and each of the third numbers in the third spaces 221 shifts rightwards through one blank as shown in FIG. 8.

It should be clear to those skilled in the art that further embodiments of the present invention may be made without departing from the scope and spirit of the present invention.

What is claimed is:

1. A perpetual calendar assembly comprising:

a transparent outer cylinder including a first end portion, a mediate portion and a second end portion;

a first opaque ring-shaped piece mounted on said first end portion of said outer cylinder and having a first viewing slot;

a second opaque ring-shaped piece mounted on said second end portion of said outer cylinder and having a second viewing slot;

a first inner cylinder rotatably mounted in said outer cylinder and including a first portion received in said first end portion of said outer cylinder and a second portion received in said mediate portion of said outer cylinder, said first portion of said first inner cylinder formed with seven first longitudinal lines intersecting with a plurality of first transverse lines, thereby defining a plurality of first spaces in each of which a first number is printed, and said second portion of said first inner cylinder formed with seven second longitudinal lines intersecting with two second transverse lines, thereby defining seven second spaces in each of which a second number is printed; and a second inner cylinder rotatably mounted in said outer cylinder and including a first portion received in said second end portion of said outer cylinder and a second portion received in said mediate portion of said outer cylinder, said first portion of said second inner cylinder formed with seven third longitudinal lines intersecting with a plurality of third transverse lines, thereby defining a plurality of third spaces in each of which a third number is printed, and said second portion of said second inner cylinder formed with seven fourth longitudinal lines intersecting with a plurality of fourth transverse lines, thereby defining a plurality of fourth spaces in each of which a fourth number is printed.

2. The perpetual calendar assembly in accordance with claim 1, wherein said first inner cylinder is formed with an annular flange abutting said first end portion of said outer cylinder.

3. The perpetual calendar assembly in accordance with claim 1, wherein said second inner cylinder is formed with an annular flange abutting said second end portion of said outer cylinder.

4. The perpetual calendar assembly in accordance with claim 1, further comprising a retaining axle extending through said first inner cylinder and said second inner cylinder.

5. The perpetual calendar assembly in accordance with claim 1, wherein said first number printed in each of said first spaces represents a particular year.

6. The perpetual calendar assembly in accordance with claim 1, wherein said first number printed in each of said first spaces represents a particular month.

7. The perpetual calendar assembly in accordance with claim 1, wherein said second number printed in each of said seven second spaces represents a corresponding one day a week.

8. The perpetual calendar assembly in accordance with claim 1, wherein said third number printed in each of said third spaces represents a particular year.

9. The perpetual calendar assembly in accordance with claim 1, wherein said third number printed in each of said third spaces represents a particular year.

10. The perpetual calendar assembly in accordance with claim 1, wherein said fourth number printed in each of said fourth spaces represents a corresponding one of thirty-one days.

11. The perpetual calendar assembly in accordance with claim 1, wherein said first viewing slot is co-axially arranged with said second viewing slot.

* * * * *